US005180299A

United States Patent [19]

Feuling

[11] Patent Number: 5,180,299

[45] Date of Patent: Jan. 19, 1993

[54] ROOTS TYPE SUPERCHARGER

[75] Inventor: James J. Feuling, Ventura, Calif.

[73] Assignee: Feuling Engineering, Inc., Ventura, Calif.

[21] Appl. No.: 873,817

[22] Filed: Apr. 27, 1992

[51] Int. Cl.[5] ..... F04C 18/18

[52] U.S. Cl. ..... 418/190; 418/206

[58] Field of Search ..... 123/559.1; 418/189, 418/190, 206

[56] References Cited

U.S. PATENT DOCUMENTS

| | | | |
|---|---|---|---|
| 859,763 | 7/1907 | Green | 418/189 |
| 1,023,360 | 4/1912 | Brauer | 418/206 X |
| 1,728,529 | 9/1929 | Butler | 418/190 |
| 1,870,192 | 8/1932 | Butler | 418/190 X |
| 3,302,868 | 2/1967 | Wrede | 418/190 |

FOREIGN PATENT DOCUMENTS

| | | | |
|---|---|---|---|
| 7991 | 1/1987 | Japan | 418/190 |
| 277881 | 11/1988 | Japan | 418/206 |
| 389287 | 10/1973 | U.S.S.R. | 418/206 |

*Primary Examiner*—Michael Koczo
*Attorney, Agent, or Firm*—Frank D. Gilliam

[57] ABSTRACT

An improved Roots type supercharger for use with high performance vehicle engines. In Roots type superchargers as the lobes of the two cooperating rotors mesh, air is compressed between the approaching lobe on one rotor and inter-lobe area on the other rotor. This rapidly and severely compressses the air caught at that nip, tending to bend the rotors, overload the bearings and the rotor end seals. Also, compression heating of that air overheats the supercharger and charge air. Both of these phenomena tend to shorten the useful life of the supercharger. To overcome this problem, a row of relief passages is provided through the face of each lobe communicating with a large interior volume within the lobe. As the perforated lobe approaches the inter-lobe area of the second rotor, the air in the nip passes through the relief passages, only slightly increasing the pressure of the relatively large volume within the lobe rather than highly increasing the pressure in the nip. The relatively small pressure increase does not distort the components or significantly increase system or charge air temperature. A plurality of relief passages may also be provided in opposite lobe faces and the lobe interior may be longitudinally divided into two volumes, each communicating with the holes on only one face, where either face may act as a leading face.

11 Claims, 2 Drawing Sheets

ROOTS TYPE SUPERCHARGER

BACKGROUND OF THE INVENTION

This invention relates in general to the Roots type supercharger and, more specifically, to improvements in reliability and operation of Roots type superchargers.

Internal combustion engines have long used superchargers of one type or another to get more air into the engine to permit more fuel to be burned and increase engine power output. A variety of superchargers have been developed, including vane type, turbochargers and Roots type superchargers.

Roots type superchargers have come into widespread use with racing automobiles, motorcycles, boats and the like because of their high efficiency and reliability. In its simplest form, a Roots type supercharger consists of two elongated rotors, each shaped like a FIG. 8 in cross section, running between end plates in an oval-shaped housing, on parallel shafts and geared together so that the rotor lobes are always in line contact. Clearances between the rotors and between rotors and the housing and end plates are kept to a minimum but with no direct contact. As the rotors rotate they collect air from an inlet in the housing and carry it around the outside and direct it to an outlet at higher pressure. Linear seals of high temperature resistant materials, such as Teflon fluorocarbon resins, may be embedded in longitudinal grooves in the faces of the lobes to contact the opposite rotor when meshed therewith to reduce air leakage therethrough.

While present Roots type superchargers are efficient, I have found that one problem significantly adversely affects operation and useful lifetime. As one lobe begins to mesh with the adjacent rotor, particularly with the linear seal arrangement, a small amount of air is rapidly compressed between the lobe and opposite rotor. The air pressure tends to very slightly bend the rotor and to escape by forcing the end plates slightly away from the rotors. Repeated many millions of times, these forces gradually adversely affect operation of the supercharger by forcing the components out of alignment and shape. Also, compression heating of the air compressed at the nip between lobes can significantly increase the temperature of the rotors and charge air. In order to assure a long effective lifetime for the supercharger, I have found that these forces must be reduced or eliminated.

Thus, there is a continuing need for improvements in Roots type superchargers.

SUMMARY OF THE INVENTION

The above-noted problem, and others, are overcome in accordance with this invention by an improvement in a conventional Roots type supercharger which comprises providing at least one longitudinal chamber within each lobe and forming a plurality of holes into that chamber through at least the leading face of the lobe. Then, as the lobe face approaches the opposite rotor and compression of air therebetween begins, the compressed air will pass through the holes into the chamber, increasing the air pressure in that chamber only very slightly, since the chamber volume is much greater that the volume in the long, narrow compressed air region or nip between lobe and opposite rotor. That slight pressure is automatically released as the lobe passes beyond the opposite rotor. A resulting pressure is applied in the rotor shaft and the end walls, so no heating, providing an effective "air pressure seal".

If desired, a reinforcing web may divide the chamber in any desired manner. Where holes are used in only one lobe face, the entire chamber may be interconnected so that a maximum volume on all sides of any internal web(s) can be used to accept the air from the compressed air region.

In some cases, such as in the case of staggered rotors where lobes may engage adjacent rotors from different directions, so that both faces may be a leading face with respect to one other rotor, it is preferred that the chamber be divided longitudinally all the way from one end wall to the other and the holes be provided in both faces.

While any suitable number and arrangement of holes may be used, in general a substantially straight row of spaced small holes along a line parallel to the rotor shaft and extending substantially the entire length of the lobe is preferred for simplicity and uniform exposure to pressure in the lobe compressed region.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
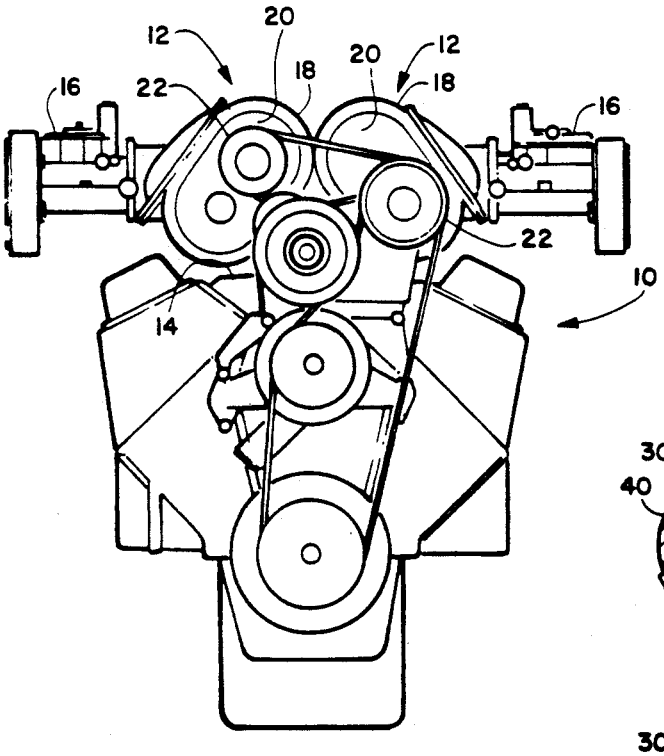
FIG. 1 is a schematic front elevation view of an automobile engine using a pair of Roots type superchargers.

Referring now to FIG. 1 there is seen a schematic front view of an automobile engine 10 having a pair of improved Roots type superchargers 12 mounted on the engine intake manifold 14 and supporting a pair of carburetors 16. Superchargers 12 include an oval-shaped housing 18, end walls 20, and driven rotor shafts driven through pulleys 22 in a conventional manner.

Figure 2:
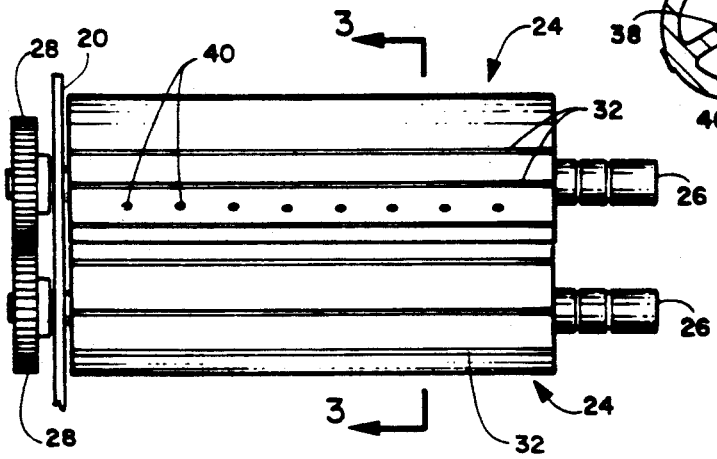
FIG. 2 is a side view of a pair of intermeshed, three-lobe rotors.

A supercharger 12, with housing 18, one end wall 20 and other associated components removed for clarity is shown in side view in FIG. 2. A pair of three-lobed rotors 24 are mounted on rotatable shafts 26. Shafts 26 are mounted in bearings (not shown) in end walls 20. At the left end as seen in FIG. 2, a pair of precisely equal sized gears 28 are mounted on shafts 26 and mesh to assure equal rotation of rotors 24.

Figure 3:
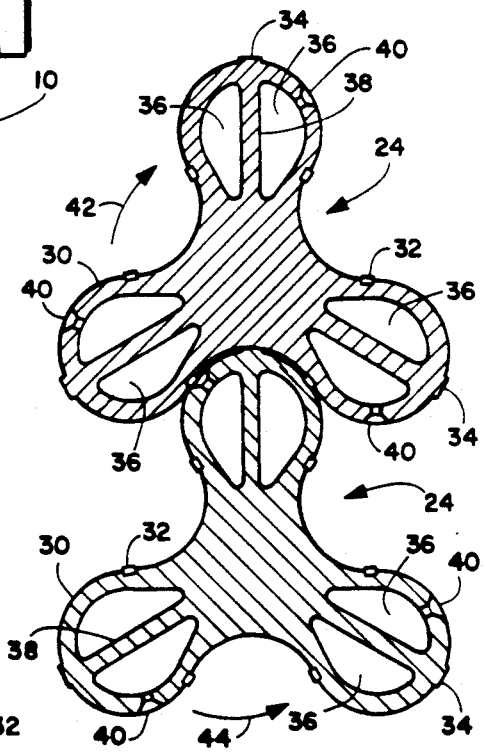
FIG. 3 is a section view taken on line 3—3 in FIG. 2 with the rotors in a first position.

As seen in section in FIG. 3, each rotor 24 carries three lobes 30 which are precisely shaped and sized to mesh with the inter-lobe space on the opposite rotor, but to not quite contact that opposite rotor. For better sealing against air leakage between lobe and rotor, thin longitudinal strips 32 of a sealing material, such as Teflon fluorocarbon, are embedded in lobe grooves. As is conventional, the ends of lobes 30 preferably have a narrow precisely machined land 34 which very closely approaches, but does not contact the inner wall of housing 18 as the rotors 24 rotate.

A longitudinal chamber 36 is formed in each lobe 30. While the chamber may be a single chamber occupying the entire interior of lobe 30, in this case a reinforcing web 38 divides chamber 36. A plurality of openings or holes 40 are formed in the leading face of each lobe 30; that is, the face that is on the front side as the rotor rotates in the direction indicated by arrows 42 and 44. Where openings or holes 40 are provided on only the leading face of lobes 30, preferably webs 38 do not seal the halves of chamber 36 from each other, so as to provide the largest possible chamber, such as by not extending all of the way to the side walls.

Figure 4:
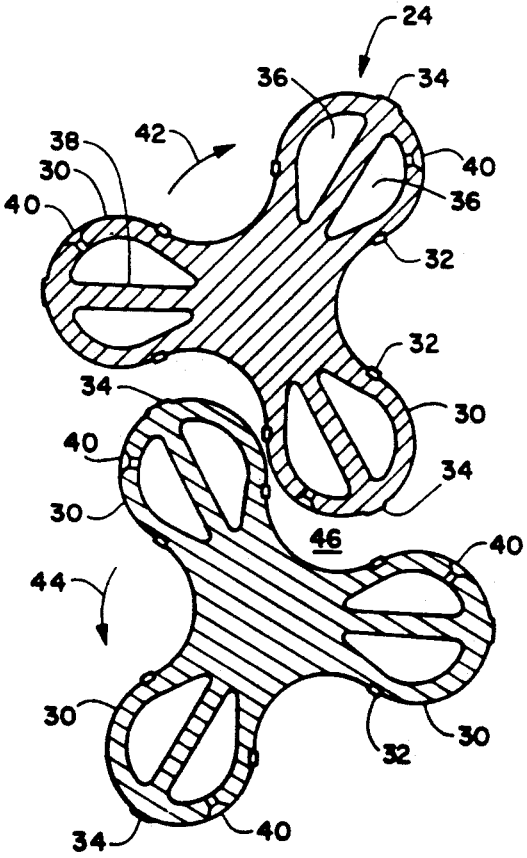
FIG. 4 is a section view corresponding to that of FIG. 3, but with the rotors in a slightly rotated position.

The function of the openings or holes 40 is best illustrated in FIG. 4, which shows lobes 30 rotated somewhat beyond the position of FIG. 3, in the direction of arrows 42 and 44. As lower right lobe 30 on the upper rotor approaches the lower rotor, air in the region 46 is trapped, in particular because of the extension of the lobe caused by land. This air tends to be forced longitudinally down along the lobes to the end plate, which it forces slightly away from the ends of the rotors. Also, the pressure of this highly compressed air in this region tends to spring or bend the rotor against which the lobe is moving. These movements or bending of the end covers and rotor shafts, while slight individually, after millions of repetitions, cause permanent deformation, resulting in undesired wear, distortion and air leakage. The compressive heating of the air in the compressed region also tends to severely heat the rotors and charge air during continuous supercharger operation, to the detriment of the entire system.

I have found that openings or holes 40 overcome this problem. The openings, which preferably are located over the center of the compressed air region, allow the captured air to pass through into chamber interior, where the relative difference in volumes is so great that there is not a significant increase in chamber pressure. This feature provides for an effective one way flow during pressurization increasing the effectiveness of the rotor to end wall housing seal. Once rotation of a rotor has continued to the point where the holes are again exposed, that slight air pressure is released to the housing 18 equalizing the pressures therebetween.

Where there are openings or holes 40 on only one side of each lobe, as in FIGS. 3 and 4, it is preferred that openings or holes be provided in web 38 so that all of chamber 36 may receive air from the nip 46. This communication may be conveniently be provided by simply stopping the length of webs 38 short of the end walls 20.

Figure 5:
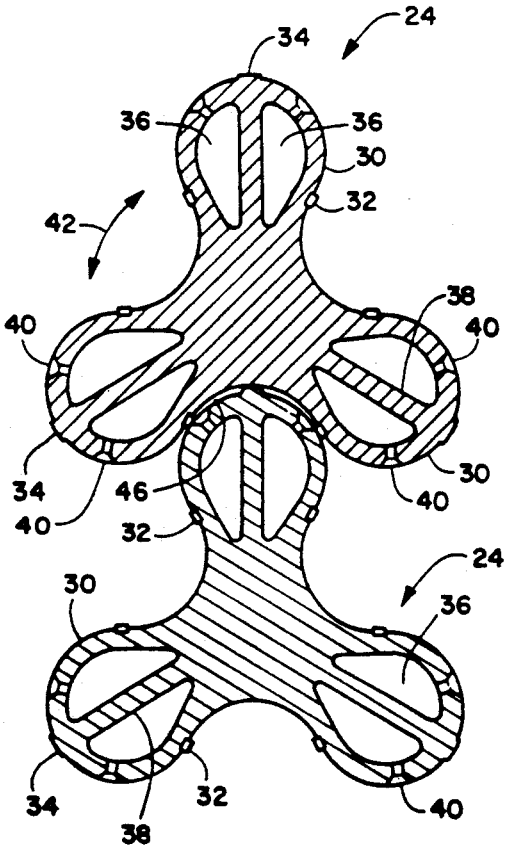
FIG. 5 is an alternative embodiment to that shown in FIG. 3.

In some applications, either face of each lobe 30 may act as "leading faces" and move towards an opposite rotor. In that case, it is preferred that the openings or holes 40 be provided in both sides of each lobe 30 as shown in the embodiment illustrated in FIG. 5. In this case, it is necessary to have two longitudinal chambers 36, entirely divided by web 38. This can be conveniently provided simply by extending web into sealing engagement with end walls 20. If any communication is provided across web 38 in this embodiment, air would, of course leak across lobes with both sets of holes exposed, such as the upper lobe in FIG. 5.

Other applications, variations and ramifications of this invention will occur to those skilled in the art upon reading this disclosure. Those are intended to be included within the scope of this invention, as defined in the appended claims.

I claim:

1. An improved Roots type supercharger which comprises:

a housing having a gas inlet and gas outlet;

a pair of elongated parallel rotors mounted for rotation within said housing;

each of said rotors having at least two elongated parallel lobes adapted to have the lobes on one rotor intermesh with minimum clearance with the lobes on the opposite rotors;

means for rotting said rotors to force gas from said inlet toward said outlet;

two independent longitudinal chambers within each if said lobes; and a plurality of openings through each of said lobes connecting the interior of said housing with a selected one of said chambers, at least some of said openings arranged along the leading face of each lobe as said lobe moves toward the adjacent rotor;

whereby gas compressed between each meshing rotor and adjacent rotor escapes into said chamber.

2. The supercharger according to claim 1 wherein said chambers extend the entire length of each lobe and said openings are spaced along the length of said leading face of said lobe.

3. The supercharger according to claim 2 wherein s aid openings are formed in a substantially straight line.

4. The super charger according to claim 1 wherein s aid two independent chambers extend along the length of the leading and following faces and at least some openings are provided on both the leading and following faces.

5. The supercharger according to claim 4 wherein said openings are formed in substantially straight lines on both lobe faces.

6. The supercharger according to claim 1 where each of said rotors carries three equally spaced lobes.

7. In a Roots type supercharger having a housing, an oval side wall and two opposite end walls, a pair of parallel rotors within said housing and mounted on shafts extending through said end walls, each of said rotor having at least two longitudinal parallel lobes adapted to mesh with the lobes on he opposite rotor when said rotors are rotated, the improvement comprising:

two independent chambers within each of said lobes, said chambers are provided along the length of the leading and following faces of said lobes, a plurality of openings through each of said lobes connecting said chambers with the housing interior, at least some of the openings located along said leading and following faces of said lobe.

8. The improvement according to claim 7 wherein chamber extends the entire length of each lobe and said openings are spaced along the length of said leading face of said lobe.

9. The improvement according to claim 8 wherein s aid openings are formed in a substantially straight line.

10. The improvement according to claim 7 wherein said openings are formed in substantially straight lines on both lobe faces.

11. The improvement according to claim 7 where each of said rotors carries three equally spaced lobes.

* * * * *